US005558053A

United States Patent [19]

Tortul

[11] Patent Number: 5,558,053

[45] Date of Patent: Sep. 24, 1996

[54] TIMING VARIATOR BETWEEN THE CRANKSHAFT AND THE CAMSHAFT OF AN INTERNAL COMBUSTION ENGINE

[75] Inventor: Renzo Tortul, S. Pier D'Isonzo, Italy

[73] Assignee: Carraro S.p.A., Campodarsego, Italy

[21] Appl. No.: 321,830

[22] Filed: Oct. 6, 1994

[30] Foreign Application Priority Data

Oct. 6, 1993 [IT] Italy ..... MI93A2125

[51] Int. Cl.[6] ..... F01L 1/344

[52] U.S. Cl. ..... 123/90.17; 123/90.31

[58] Field of Search ..... 123/90.15, 90.17, 123/90.31; 74/568 R, 567; 464/1, 2, 160

[56] References Cited

U.S. PATENT DOCUMENTS 4,936,264 6/1990 Suga ..... 123/90.17
5,067,450 11/1991 Kano et al. ..... 123/90.17
5,181,484 1/1993 Kan et al. ..... 123/90.17
5,205,248 4/1993 Hara et al. ..... 123/90.17

*Primary Examiner*—Weilun Lo
*Attorney, Agent, or Firm*—Sughrue, Mion, Zinn, Macpeak & Seas

[57] ABSTRACT

A timing variator disposed between a crankshaft and a camshaft of an internal combustion engine includes a body portion connected to the crankshaft and a hub connected to the camshaft. A piston is interposed between the body and the hub and coupled thereto by helical gearing for changing the angular position of the body relative to the hub. A torsion member is connected between the body and the hub for producing a torque therebetween and/or a braking device is disposed between the body and the hub to brake relative movement therebetween.

16 Claims, 6 Drawing Sheets

TIMING VARIATOR BETWEEN THE CRANKSHAFT AND THE CAMSHAFT OF AN INTERNAL COMBUSTION ENGINE

BACKGROUND OF THE INVENTION

The present invention relates to a timing variator between the crankshaft and the camshaft of an internal combustion engine.

As is well known, the timing variator of an internal combustion engine is a mechanism which enables the timing system setting to be changed to optimize the engine performance at varying loads and rpm.

A timing variator commonly employed is a hydromechanical type having a first element connected drivingly to the engine crankshaft, a second element connected drivingly to the timing system camshaft, and a piston member mounted between and coupled to said elements. In particular, the piston member is coupled to one of the two elements by means of helical gears. The piston member is moved relative to said elements by a working fluid which is regulated by a valve under control by an electronic control unit for the engine. The movement of the piston member produces, through the gear coupling arrangement, a relative angular displacement of said two elements, thereby changing the timing angle relationship of the camshaft to the crankshaft, and hence the engine valve timing.

However, timing variators of the type outlined above may present a problem of substantial importance.

In conjunction with the classic timing system including valves and valve springs, due to continued reversal of the reaction load on the camshaft, as produced by the timing system dynamic mode during the variator operation, rattling noise is generated by a continued mutual reciprocation of the enmeshed teeth as the load direction is reversed which is due to their backlash. This makes for noisy operation of the timing variator and the engine to which it is incorporated. In addition, the gear teeth rate of wear is increased.

To avoid this problem, a perfect fit would have to be provided between the teeth of the coupling arrangements, but this is quite difficult to accomplish in the manufacturing process, and hence impractical.

Solutions to the problem have actually been proposed. One solution provides a split piston member in two parts to effectively offset consecutive helical gear sections on the two parts by application to such parts of an appropriate elastic load to take up the backlash between the teeth. Another solution provides for the fast reciprocating movements of the gears to be damped by a viscous fluid. Such solutions involve, however, significant structural and functional complications that lead to high manufacturing costs and inferior reliability.

SUMMARY OF THE INVENTION

It is the object of the present invention to provide a timing variator which can solve the above-mentioned noise problem and at the same time, be structurally and functionally simple.

This object is achieved by a timing variator between the crankshaft and the camshaft of an internal combustion engine, comprising a first element drivingly connected to the crankshaft, a second element drivingly connected to the camshaft, a piston member interposed between the first and the second element and coupled to one of said elements by a helical gear teeth coupling arrangement and to the other of the two elements either by a spur gear teeth or helical gear teeth coupling arrangement, said piston member being moved relative to said elements to change the angular setting of the two elements through the gear teeth coupling arrangements, thereby changing the crankshaft/camshaft timing relationship, characterized in that it comprises torque means associated with said elements to generate a torque between said elements and/or braking means between said elements for braking the movement of one element relative to the other.

BRIEF DESCRIPTION OF THE DRAWINGS

The invention can be more clearly understood from the following description of four non-limitative embodiments thereof illustrated by the accompanying drawings, in which.

DETAILED DESCRIPTION OF THE INVENTION

Figure 1:
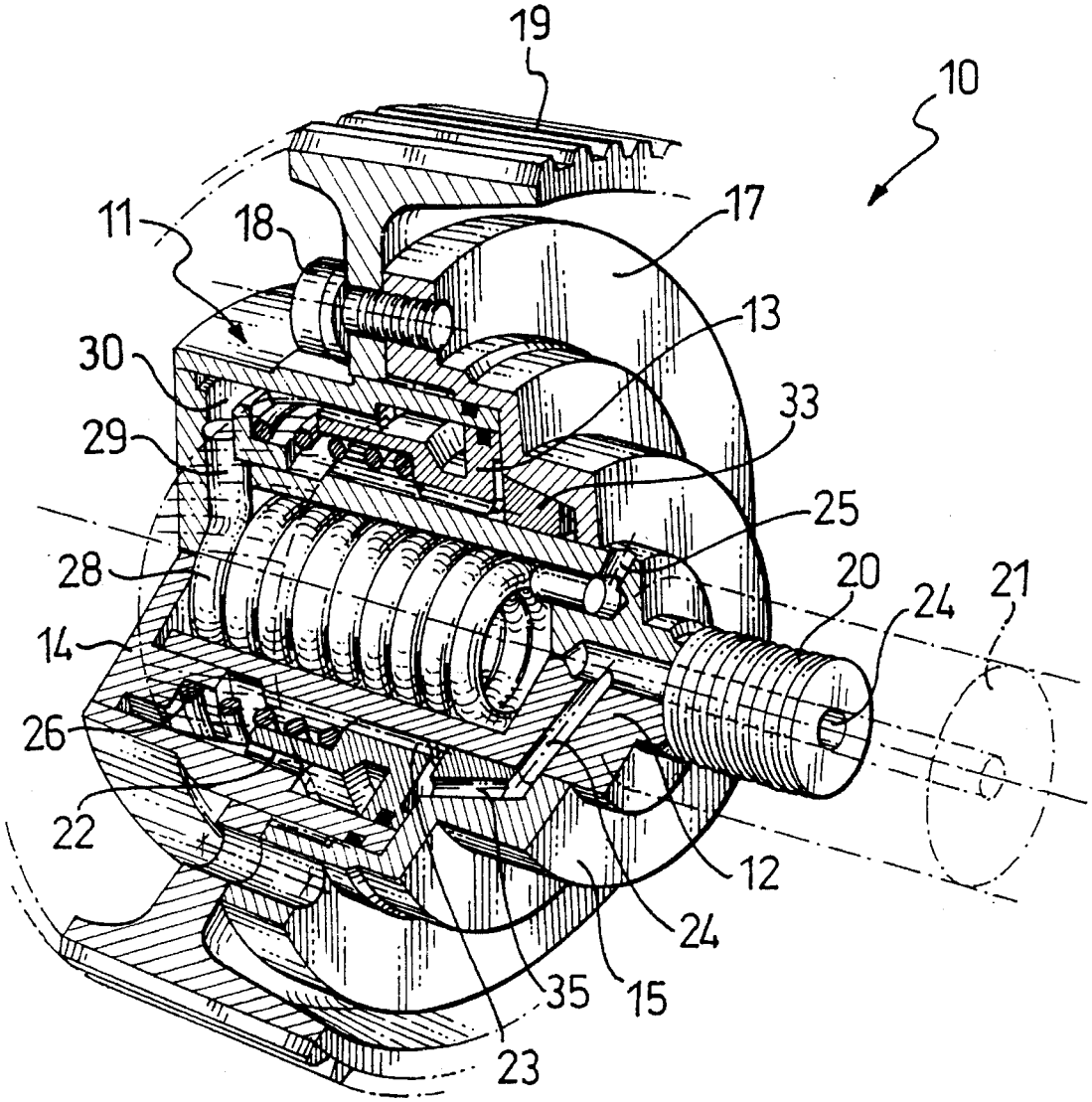
FIG. 1 is a cut-away perspective view of a first timing variator according to the invention.
Figure 2:
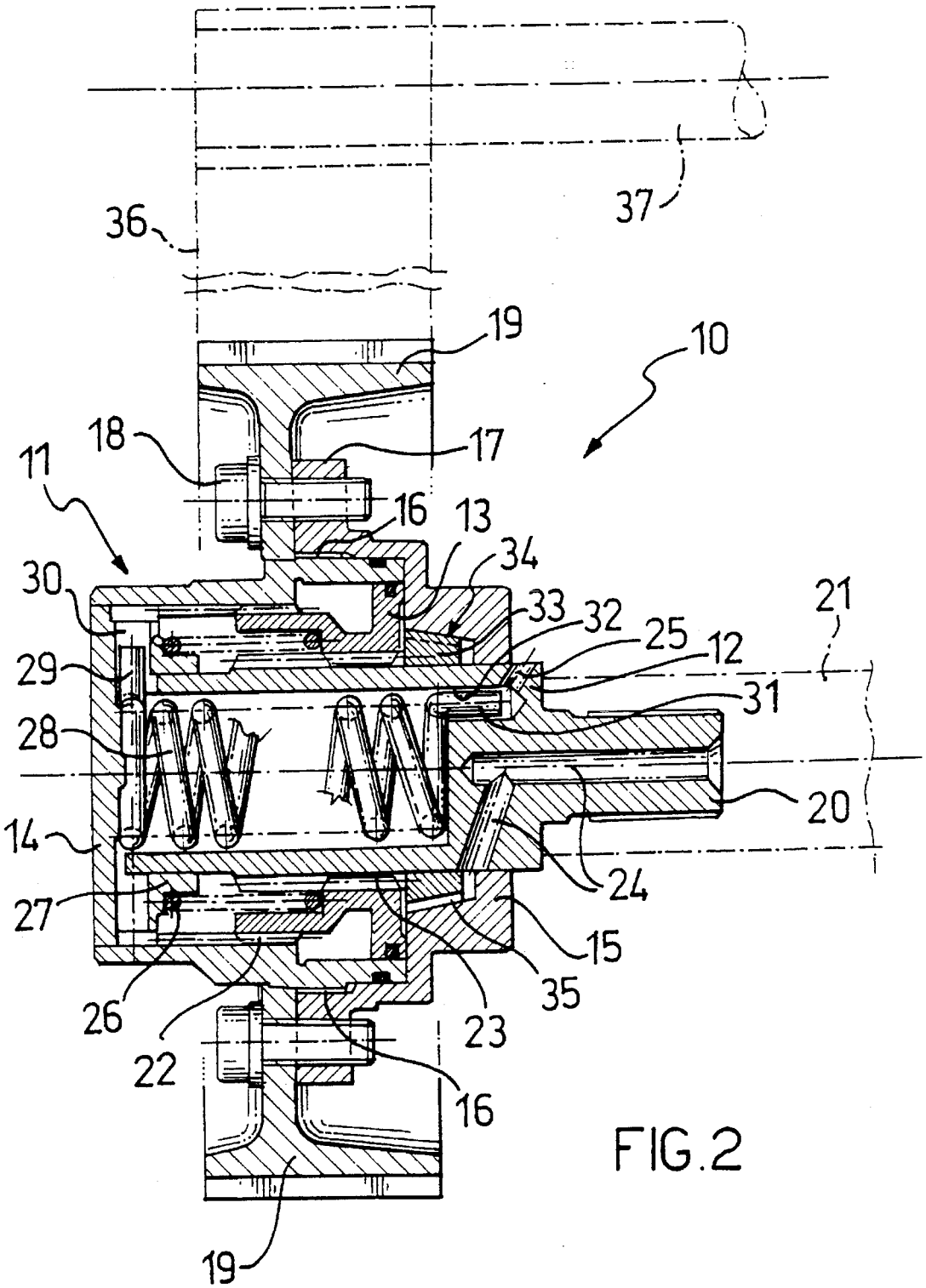
FIG. 2 is a sectional plan view of a variator shown in FIG. 1.

The timing variator shown generally at 10 in FIGS. 1 and 2 comprises a first element consisting of a hollow body 11, a second element consisting of a hollow hub 12 received coaxially inside the body 11, and an annular piston 13 also disposed coaxially between the body 11 and the hub 12.

The body 11 is made up of two halves 14 and 15 held together by a screw joint 16. Fastened to a flange 17 of the half-body 15 by means of screws 18 is a gear wheel 19 driven rotatively from a crankshaft 37, shown in chain lines, of an internal combustion engine through a cogged drive belt 36, also shown in chain lines.

The hub 12 has a threaded tang 20 which is secured threadably to a camshaft 21 shown in chain lines. The camshaft 21 conventionally operates spring-biased valves in the timing system of the I.C. engine.

The piston 13 carries on its exterior helical gear teeth which mesh with mating helical inside gear teeth in the half-body 14; the combination of these helical gear teeth is generally indicated at 22. In addition, the piston 13 is provided on its interior with spur gear teeth which mesh with mating spur gear teeth provided on the hub 12 exterior; the combination of these spur gear teeth is generally indicated at 23.

Formed within the hub 12 and tang 20 are channels 24 for conveying into and out of the body 11 a working fluid for the piston 13. Also formed in the hub 12 is a channel 25 for draining the fluid out of the body 11.

A coil spring 26 is arranged to push with one end against an abutment 27 on the half-body 14 and with the other end against the piston 13.

The hub 12 accommodates a cylindrical coil spring 28 which is preloaded both torsionally and axially and formed from circular cross-section wire. This spring 28 has one end 29 of the wire inserted into a socket 30 on the half-body 14 and the other wire end 31 inserted into a socket 32 on the hub 12. Further, the spring 28 is arranged to push against the half-body 14 on the one side, and against the hub 12 on the other.

Fitted tightly over the hub 12 is a ring 33 which has a conical outer surface and cylindrical inner surface. The half-body 15 has a conical inner surface in contact with the conical outer surface of the ring 33; the taper fit of said two conical surfaces of the ring 33 and the half-body 15 is indicated at 34. The ring 33 is formed peripherally with recesses 35 which admit the flow of working fluid into the body 11 inside, where the piston 13 is accommodated, from the channels 24.

The timing variator 10 just described operates as follows.

The crankshaft rotation is transferred to the camshaft 21 to operate the engine valves via the gear wheel 19, body 11, piston 13, and hub 12. The gear couplings 22 and 23 entrain rotatively the body 11, piston 13, and hub 12 as one.

To change the valve timing, e.g. to advance the valve opening, pressurized fluid is delivered into the body 11 through the channels 24 under control from an electronic control unit of the engine via a respective solenoid valve, thereby causing the piston 13 to be moved leftwards (as viewed in FIGS. 1, 2) to a travel end position defined by the abutment 27. The piston 13 will, therefore, move axially along the hub 12 because of the spur gear teeth coupling 23, while being screwed into the body 11 because of the helical gear teeth coupling 22. The piston 13 will in its screw movement entrain rotatively the hub 12, so that a relative rotation will be produced between the body 11 and the hub 12 effective to change the timing relationship of the camshaft 21 to the crankshaft 37 and hence the valve timing.

To restore the timing to its original setting, the channels 24 are communicated, under control by the electronic unit via the solenoid valve, to the discharge end such that the working fluid can be dumped out. The spring 28 produces a torque between the body 11 and the hub 12 due to the way it has been arranged and connected. As mentioned, it is preloaded elastically since when the variator 10 occupies its starting position shown in FIGS. 1, 2, and is further twisted as the piston 13 is displaced by the working fluid to change the original timing. The action of this spring 28 then causes the body 11 and hub 12 to move back to their original relative angular positions, thereby also restoring the piston 13 to its original position, which will dump out the working fluid. Added to this action of the spring 28 are the bias of the spring 26 and the effect of the axial components of the forces acting between the helical gear teeth of the gear coupling 22.

A unique feature of the spring 28 is, however, that it tends to hold the gear teeth of the gear couplings 22 and 23 close together by virtue of the torque it exerts between the body 11 and the hub 12. This torque is applied to the gear couplings 22 and 23 through the piston 13. This allows the continued reciprocation of the teeth mentioned in the introductory notes to be suppressed, thereby making the operation of the timing variator 10 quieter.

Another effect is produced by the conical fit 34 in combination with the axial trust from the spring 28. In particular, the conical surfaces of the conical fit 34 are held close together by the thrust on the body 11 and the hub 12 from the spring 28 tending to make the fit even tighter. Consequently, the friction between the conical surfaces will stop any relative rotation of the body 11 and the hub 12, thereby braking the aforesaid reciprocating movement of the teeth of the gear couplings 22 and 23 on account of the various parts being linked together. In this way, the previously mentioned effect of the spring 28 torque combines with this frictional effect to suppress the continued reciprocating movement of the gear teeth.

It should be emphasized that all this is obtained by the mere provision of a coil spring and a ring. Thus, the resultant timing variator will be simple both structurally and functionally, and accordingly low in manufacturing cost and highly reliable.

Figure 3:
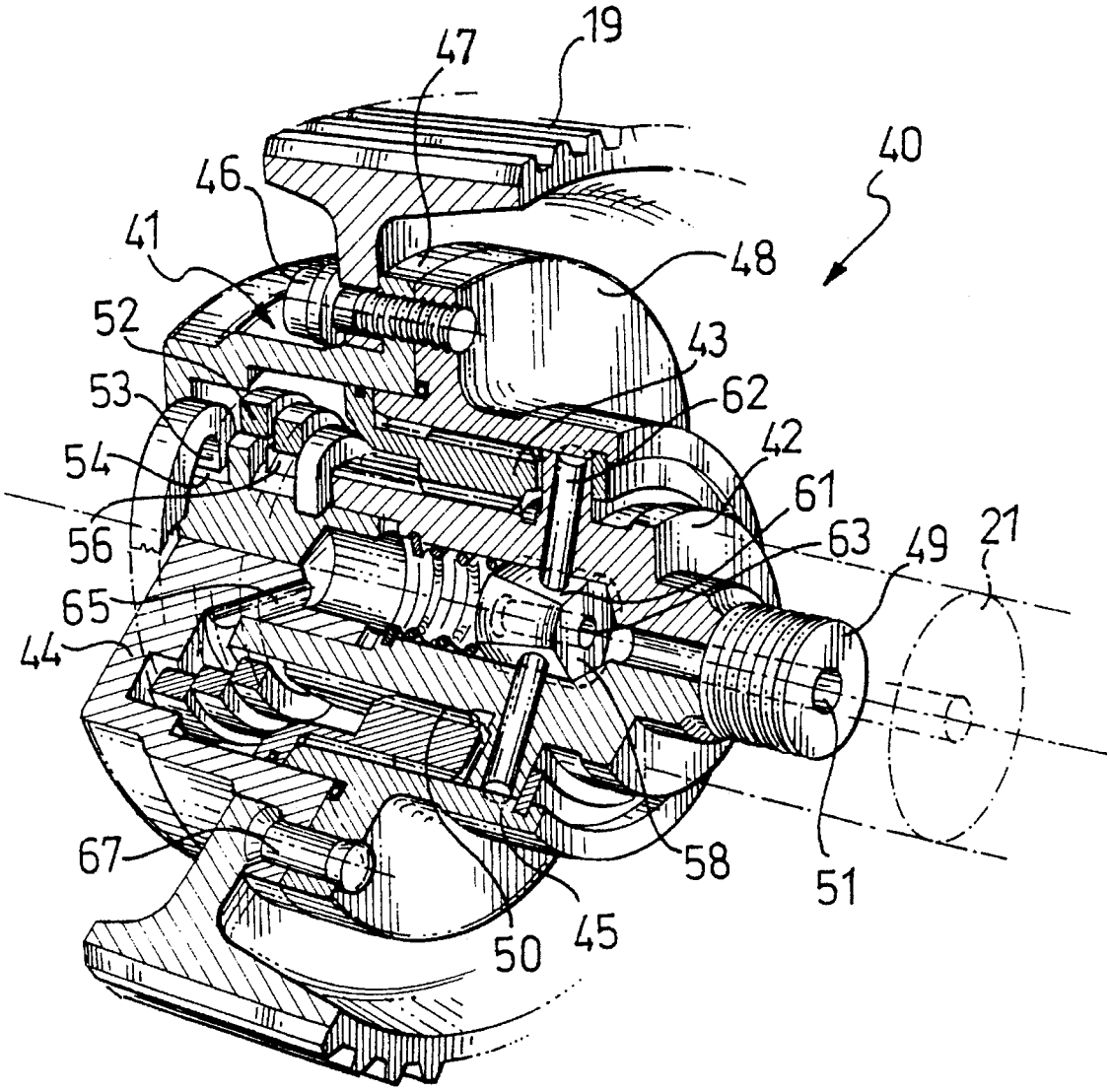
FIG. 3 is a cut-away perspective view of a second timing variator according to the invention.
Figure 4:
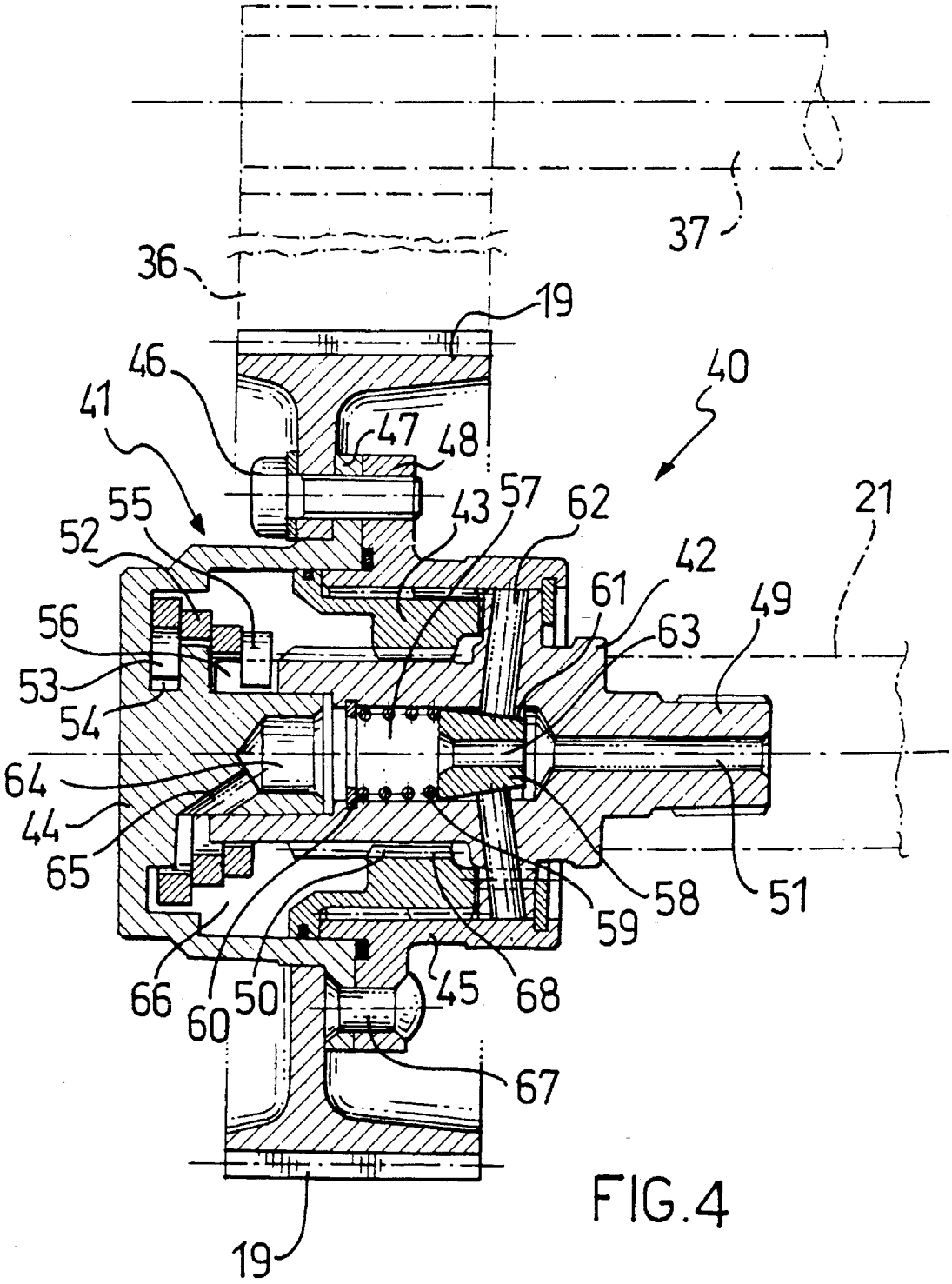
FIG. 4 is a sectional plan view of the variator shown in FIG. 3.

The timing variator generally shown at 40 in FIGS. 3, 4 also comprises a hollow body 41, a hollow hub 42 received coaxially within the body 41, and an annular piston 43 also mounted coaxially between the body 41 and the hub 42.

Here again, the body 41 is made up of two half-bodies 44 and 45. These half-bodies 44, 45 are held together by rivets 67 and attached to the aforementioned gear wheel 19 by screws 46 which are passed through said wheel and a flange 47 on the half-body 44 and threaded into a flange 48 on the half-body 45. The gear wheel 19 is, as previously described, driven from the crankshaft 37 of the I.C. engine through a cogged drive belt 36.

The hub 42 is retained axially in the body 41 and provided, similar to the hub 12, with a threaded tang 49 made rigid with the camshaft 21 by means of a screw interfit.

The piston 43 is coupled to the half-body 45 by a helical gear teeth coupling arrangement 68 and to the hub 42 by means of a spur gear teeth coupling arrangement 60, in much the same way as the timing variator 10.

The hub 42 and the tang 49 are formed with a channel 51 for admitting the working fluid into and out of the body 41.

In this timing variator 40, the torsional function of the spring 28 in the timing variator 10 is serviced by a conical coil spring 52 formed from square cross-section wire. This spring 52 is disposed between the half-body 44 and the hub 42, and has one wire end 53 fitted into a socket 54 on the half-body 44 and the other wire end 55 fitted into a socket 56 on the hub 42.

For the purpose of frictional braking, the variator 40 utilizes a distinctive mechanism, instead of the friction ring of the variator 10. Specifically, an inner seat 57 in the hub 42 accommodates slidably therein a cylinder 58 against which a spring 59 acts which reacts against a ring 60 locked inside the seat 57; the cylinder 58 has longitudinal flats 61 on its exterior which are inclined from the cylinder axis; each flat 61 has a cross pin 62 associated therewith which fits in a respective through-going hole in the hub 42 to contact the flat with one end and the inner surface of the half-body 45 with the other end.

The cylinder 58 has an axial through-going bore 63 through which the working fluid is passed into the seat 57 and thence, through a blind hole 64 and a channel 65, both formed in the half-body 44, into a chamber 66 of the body 41 to drive the piston 43. As for changing the valve timing, the timing variator 40 operates in the same way as the timing variator 10, with the exception that the piston 43 will be moved by the working fluid in the rightward rather than leftward direction as viewed in FIGS. 3, 4. (The position of the piston 43 in FIGS. 3, 4 is the travel end position as attained under the thrust from the working fluid.)

The spring 52 is effective to produce, similar to the spring 28 in the timing variator 10, a torque between the body 41 and the hub 42, thereby biasing the piston 43 to its original position and tending to hold the teeth of the toothed couplings 68 and 60 in mutual contact. Unlike the spring 28, however, the spring 52 provides no axial thrusting action. As regards frictional braking, in the timing variator 40, the thrust force of the spring 59 against the cylinder 58 causes the inclined flats 61 to be pushed on account of their inclination against the pins 62 and to force them against the inner surface of the half-body 45, thereby frictionally braking the relative rotary movement of the body 41 and the hub 42.

Thus, the timing variator 40 has the same noise-suppression quality as the timing variator 10. Again, this is accomplished by the use of few elements to provide structural and functional simplicity, and the consequent advantages.

Figure 5:
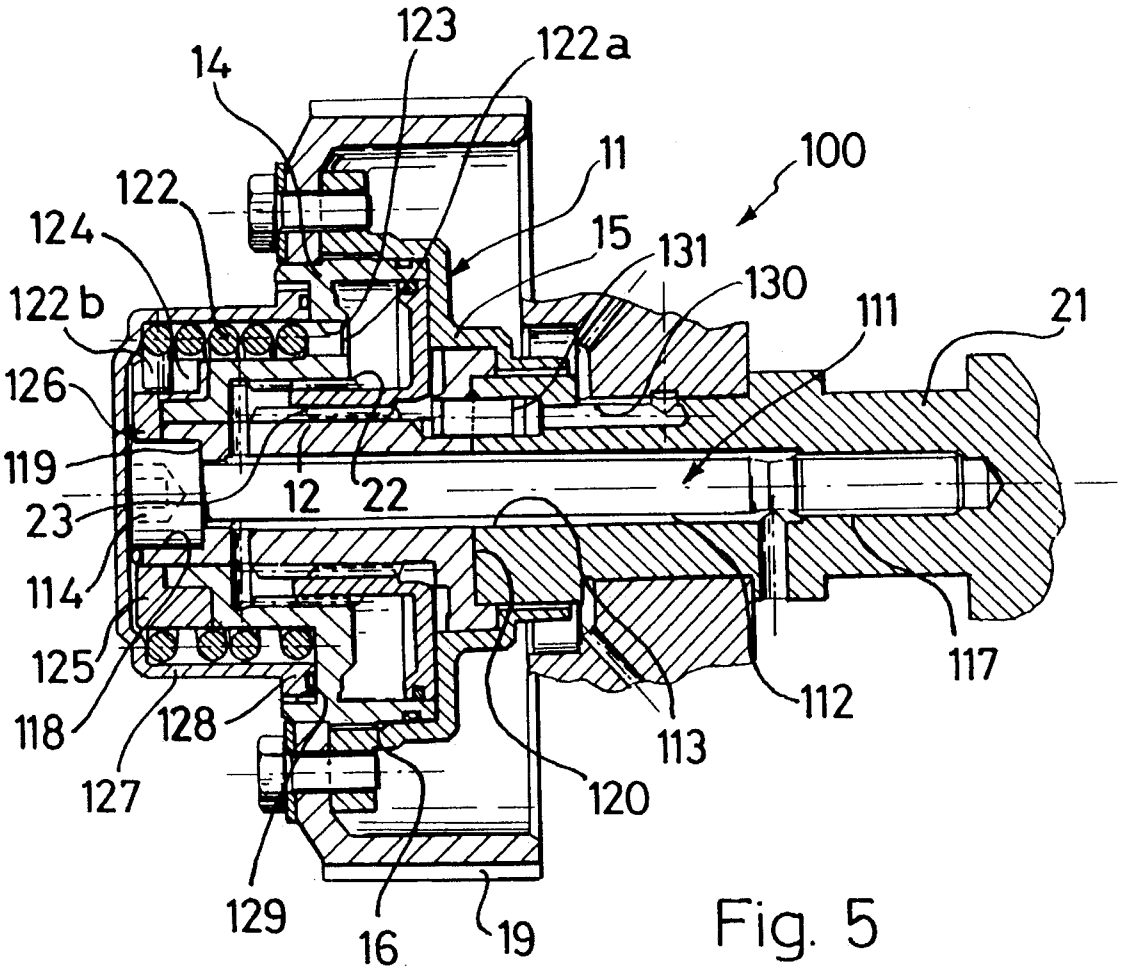
FIG. 5 is an axial section view of a third timing variator according to the invention.

Generally shown at 100 in FIG. 5 is a third example of the timing variator of this invention.

Similar parts to those in the example of FIGS. 12 and 2 are denoted by the same reference numerals. As in the previous example, the variator 100 comprises a first element, consisting of a hollow body 11, a second element consisting of a hub 12, and a third element consisting of an annular piston 13 interposed between the body 11 and the hub 12. These elements are all coaxial with one another.

The hub 12 is joined to a camshaft 21 by a screw 111 whose shank 112 extends through an axial through-hole 113 to engage in an axial threaded hold 117 of the camshaft 21. The screw 111 has a head 114 received in a socket 118 on the free end of the hub 12 where it abuts against a shoulder 119. The hub is held by the screw 111 in a position with a surface 120 against the free end of the camshaft 21. The hole 113 also forms a channel for draining off any working fluid (pressurized oil) leaking past the piston 13 through the teeth arrangements 23. The working fluid is supplied into the variator through further conduit 130 wherein a lockpin 131 is mounted to set the hub 12 angularly with respect to the camshaft 21 and make it more certain that the hub 12 is rotated with the shaft 21.

To reduce the rattling noise from the gear teeth 22, 23, a coil spring 122 is arranged to act as a torsion means between the hub 12 and the body 11 and apply a predetermined torque therebetween and, accordingly, keep in constant mutual contact the corresponding flanks of such gear teeth 22, 23. The spring 122 has opposite end sections 122*a, b* respectively engaged in a hold 123 in the half-body 14 and a groove 124 formed in an axial direction in the skirt of a collar 125 which is attached to the free end of the hub 12 such that it can be rotated therewith relative to the body 11.

The spring 122 exterior is protected by a cover 127 having an outside-threaded flange 128 engaging threadably in a corresponding recess 129 in the half-body 14. The collar 125 is preferably bonded to the end of the hub by means of a splined connection 126. In this way, the collar can be rotated relative to the hub 12 when the cover 127 is removed from the body 11, to place a predetermined torsional preload on the spring 122.

Figure 8:
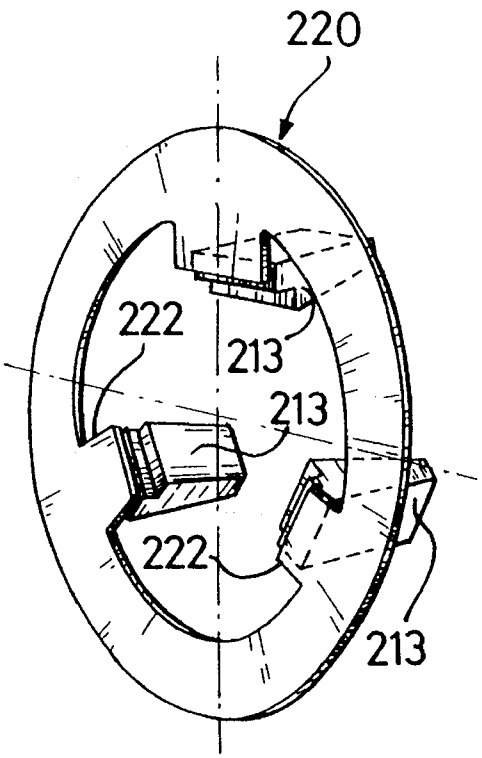
FIGS. 7 and 8 are fragmentary perspective view, drawn to an enlarged scale, of a detail of the variator in FIG. 6.
Figure 7:
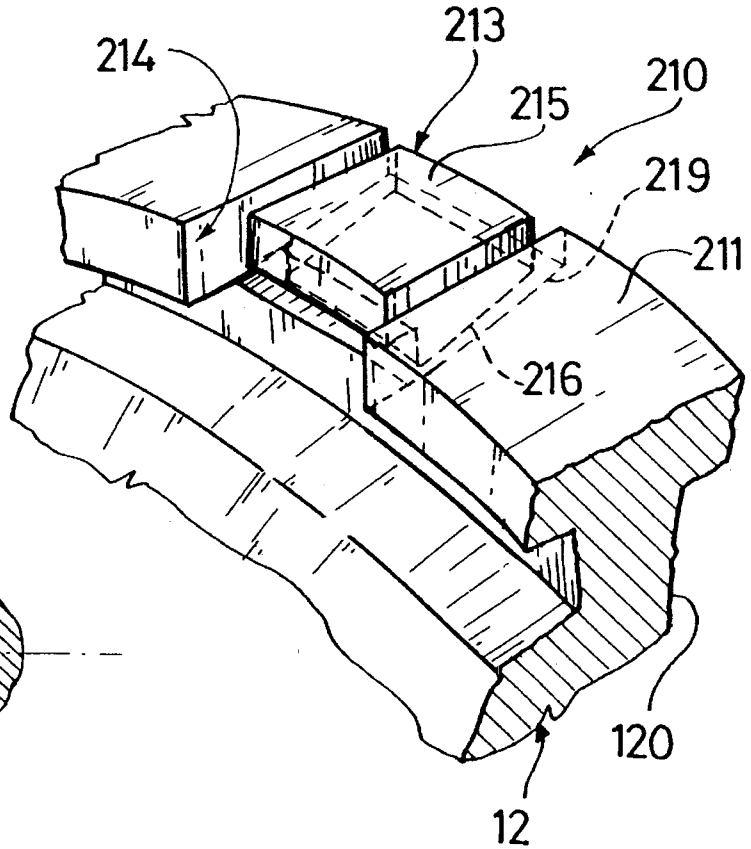
Figure 6:
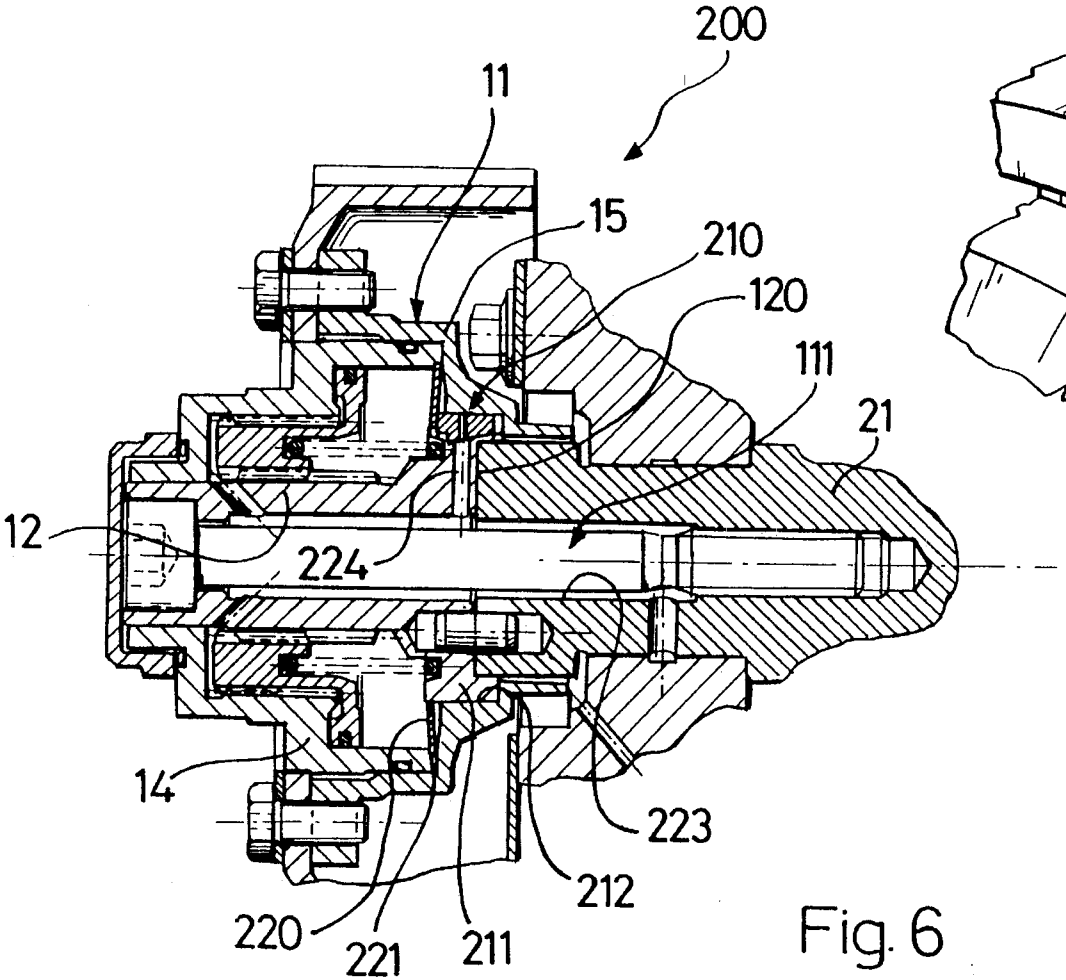
FIG. 6 is an axial section view of a fourth timing variator according to the invention.

A fourth embodiment of the invention is generally shown at 200 in FIGS. 6, 7 and 8. Similar parts are denoted by the same reference numerals as in the previous Figures. In this embodiment, the variator noise is controlled by friction braking means, generally shown at 210, between the hub 12 and the body 11. The torque means provided in the previous examples is omitted here.

The braking means 210 is active between an annular flange 211 extending from the hub 12 radially out at the abutment surface 120, and a cylinder surface 212 facing it on the half-body 15 of the variator. Said means 210 comprises a set of three or more identical shoes, all indicated at 213, slidable parallel to the variator axis in respective seats 214 formed in the skirt of the flanges 211.

Each shoe 213 has a wedge-shaped profile with a curved surface 215 facing the surface 212 and shaped to match the profile of the latter and an opposite flat surface 216 tapering into a ramp. The corresponding seats 214 each have a ramp surface 219 co-operating with the surface 216 to move the shoe 213 radially away from the axis of the hub 12 as a result of the shoe 213 movement in an axial direction. To urge the shoes in such a direction, a Belleville washer 220 is retained, at is outside diameter, in a groove 221 in the half-body 14 and has three wings 222 projecting radially inwards and acting on corresponding shoes 213 with a predetermined elastic load.

A radial conduit 224 opens into each seat 214 which extends from a channel 223 admitting pressurized oil for driving the piston 13 and is continued through the respective shoe 213 to lubricate the surfaces 212 and 219.

Variations from and additions to what has been described in the foregoing and illustrated in the drawings, are of course, possible.

The piston and hub of the timing variator may be coupled together using helical gear teeth rather than a spur gear teeth arrangement. It may also be arranged for the piston and the body to be engaged together by a spur gear teeth coupling, and the piston and hub by a helical gear teeth coupling.

The timing variator could either make use of the torque spring alone or just the friction braking system.

Instead of the coil spring, a torsion rod or equivalents thereof could be used to produce a torque between the body and the hub, although the coil spring is at one time structurally simple and function-wise effective.

The timing variator 10 could do without the spring 26 assist, and the spring 28 alone could be used to bias the piston back to its original position, just as in the timing variator 40.

The ring 33 may be a single piece fitted tightly over the hub 12 or assembled from several pieces, each in the shape of a circular arc, clamped between the half-body 15 and the hub 12. The ring, moreover, could be attached to the body of the timing variator and form a conical fit with the hub.

Equivalent friction braking means of those described above may be used, provided that they are effective to brake the relative movement of the body and the hub by frictional engagement, although those described are at one time simple in construction and functionally effective.

Changes in the design and number of the components clearly may be applied to the timing variators described.

While the invention has been particularly shown and described with reference to preferred embodiments thereof, it will be understood by those in the art that the foregoing and other changes in form and details may be made therein without departing from the spirit and scope of the invention.

I claim:

1. A timing variator (10;40) between a crankshaft (37) and a camshaft (21) of an internal combustion engine, comprising a first element (11;41) drivingly connected to the crankshaft (37), a second element (12;42) drivingly connected to the camshaft (21), a piston member (13;43) interposed between the first (11;41) and the second (12;42) elements and coupled to one (11;41) of said elements by a helical gear arrangement (22;68) and to the other (12;42) of the two elements either by a spur gear or helical gear arrangement (23;50), said piston member (13;43) being displaced relative to said elements (11,12; 41,42) to change the angular setting of the two elements (11,12' 41,42) through the gear arrangements (22,23; 58,60), thereby changing the camshaft (21) to crankshaft (37) timing relationship, wherein said timing variator further comprises torque means (28;52) associated with said elements (11,12; 41,42) to generate a torque between said elements (11;41 and 12;42) and braking means (33,34; 59–62) between said elements (11,12; 41,42) for braking the movement of one element (11;41) relative to the other (12;42) wherein said torque means comprises a torsionally preloaded spring connected at one end to said first element and at the other end to said second element.

2. A timing variator according to claim 1, wherein said spring is a coil spring (28;52).

3. A timing variator according to claim 1, wherein said braking means are mechanical friction braking means (33, 34;59–62).

4. A timing variator according to claim 3, wherein said mechanical friction braking means comprise a ring (33) disposed between the first (11) and the second (12) element, mounted for rotation with one (12) of said elements (11,12), and frictionally engaged with the other (11) of said elements (11,12) by an elastically tight conical fit (34).

5. A timing variator according to claim 4, wherein the elastically tightened conical fit (34) is obtained using a spring (28) which acts on said elements (11,12) in the tightening direction of the conical fit (34).

6. A timing variator according to claim 2, wherein said mechanical friction braking means comprise a ring (33) interposed between the first (11) and the second (12) element, secured to one (12) of said elements (11,12), and frictionally engaged with the other (11) of said elements (11,12) by a conical fit (34), said coil spring (28) also acting axially on said elements (11,12) to elastically tighten said conical fit.

7. A timing variator according to claim 1, wherein said spring is operatively connected to said braking means for applying a braking force to break movement of one element relative to the other.

8. A timing variator according to claim 3, wherein said mechanical friction braking means comprises a plurality of shoes (213) interposed between the first and the second element (11,12) mounted for rotation with one (12) of said elements and elastically pushed against a friction surface (212) defined on the other (11) of said elements.

9. A timing variator according to claim 1, wherein the first element is a hollow body (11;41) and the second element is a hub (12;42) received in the hollow body (11;41) together with the piston member (13;43).

10. A timing variator according to claim 9, wherein the hollow body (11;41) is made up of two half-bodies (14, 15;44,45) held together.

11. A timing variator according to claim 10, wherein the two half-bodies (14,16) are secured to each other by a screw (16) attachment.

12. A timing variator according to claim 10, wherein the two half-bodies (14,16) are secured to each other by means of rivets (67).

13. A timing variator according to claim 8, wherein said shoes (213) are guided for movement along a longitudinal axis of the second element in corresponding seats (214) of the second element (12), said shoes and said seats having respective ramp-like contact surfaces (216,219) arranged to produce a radial displacement relative to said longitudinal axis of each shoe relative to the second element as a result of displacement of the shoe in the corresponding seat along said longitudinal axis.

14. A timing variator (10;40) between a crankshaft (37) and a camshaft (21) of an internal combustion engine, comprising a first element (11;41) drivingly connected to the crankshaft (37), a second element (12;42) drivingly connected to the camshaft (21), a piston member (13;43) interposed between the first (11;41) and the second (12;42) elements and coupled to one (11;41) of said elements by a helical gear arrangement (22;68) and to the other (12;42) of the two elements either by a spur gear or helical gear arrangement (23;50), said piston member (13;43) being displaced relative to said elements (11,12; 41,42) to change the angular setting of the two elements (11,12; 41,42) through the gear arrangements (22,23; 58,60), thereby changing the camshaft (21) to crankshaft (37) timing relationship, wherein said timing variator further comprises braking means (33,34; 59–62) between said elements (11,12; 41,42) for braking the movement of one element (11;41) relative to the other (12;42)

wherein said braking means is a mechanical friction braking means and comprises a thrust member (58) received inside the second element (42) for movement along an axis of said second element and having surfaces inclined relative to said axis, friction members (62) for frictional engagement with the first element (41) received transversely inside the second element (42) and engaging said thrust member (58), an elastic member (59) biasing the thrust member (58) such that the thrust member (58) pushes by means of the inclined surfaces the friction members (62) against the first element (41).

15. A timing variator according to claim 14, wherein the thrust member is a cylinder (58) said inclined surfaces are formed by inclined flat surfaces (61) on the cylinder (58), the friction members consist of pins (62), each in contact with a respective one of the flat surfaces at one end and in contact with the first element (41) at the other end, and the elastic member is a spring (59) received in the second element (42).

16. A timing variator (10;40) between a crankshaft (37) and a camshaft (21) of an internal combustion engine, comprising a first element (11;41) drivingly connected to the crankshaft (37), a second element (12;42) drivingly connected to the camshaft (21), a piston member (13;43) interposed between the first (11;41) and the second (12;42) elements and coupled to one (11;41) of said elements by a helical gear arrangement (22;68) and to the other (12;42) of the two elements either by a spur gear or helical gear arrangement (23;50), said piston member (13;43) being displaced relative to said elements (11,12; 41,42) to change the angular setting of the two elements (11,12; 41,42) through the gear arrangements (22,23; 58,60), thereby changing the camshaft (21) to crankshaft (37) timing relationship, wherein said timing variator further comprises torque means (28;52) associated with said elements (11,12; 41,42) to generate a torque between said elements (11;41 and 12;42) and braking means (33,34; 59–62) between said elements (11,12; 41,42) for braking the movement of one element (11;41) relative to the other (12;42) wherein said torque means comprises a torsionally preloaded spring connected at one end to said first element and at the other end to said second element, and wherein said spring (122) is attached with one end to the first element (11,12) through a collar (125) which is rotatable on said first element (12) to correspondingly change the torsional preload on said spring (122).

* * * * *